US009352810B2

(12) United States Patent
O'Brien

(10) Patent No.: US 9,352,810 B2
(45) Date of Patent: May 31, 2016

(54) CAMBER WAKEBOARD

(71) Applicant: Paul Edward O'Brien, Bellevue, WA (US)

(72) Inventor: Paul Edward O'Brien, Bellevue, WA (US)

( * ) Notice: Subject to any disclaimer, the term of this patent is extended or adjusted under 35 U.S.C. 154(b) by 0 days.

(21) Appl. No.: 14/317,729

(22) Filed: Jun. 27, 2014

(65) Prior Publication Data

US 2015/0004858 A1 Jan. 1, 2015

Related U.S. Application Data

(60) Provisional application No. 61/840,108, filed on Jun. 27, 2013.

(51) Int. Cl.
*B63B 35/79* (2006.01)
*B63B 35/81* (2006.01)

(52) U.S. Cl.
CPC ..... *B63B 35/7906* (2013.01); *B63B 35/7926* (2013.01); *B63B 2035/818* (2013.01)

(58) Field of Classification Search
CPC B63B 35/79; B63B 35/7906; B63B 35/7926; B63B 35/7909; B63B 21/56
USPC ..... 441/74; 114/39.14, 357
See application file for complete search history.

(56) References Cited

U.S. PATENT DOCUMENTS 7,134,990 B2 * 11/2006 Wischusen ..... A63B 21/0004 441/74
2011/0223821 A1 * 9/2011 Chi ..... 441/74

* cited by examiner

*Primary Examiner* — Lars A Olson
(74) *Attorney, Agent, or Firm* — Zachary W. Behler; Foster, Swift, Collins & Smith, P.C.

(57) ABSTRACT

The inventive skate technology comprises a wakeboard or other type of floatation board, particularly, but not solely, designed for use behind a watercraft and which has a longitudinal arc that curves from the lowest points upward at the tip and tail but is reversed in at least one section of the board.

20 Claims, 3 Drawing Sheets

CAMBER WAKEBOARD

CROSS REFERENCE TO RELATED APPLICATIONS

This application claims priority to U.S. provisional application Ser. No. 61/840,108, entitled "Camber Wakeboard," filed Jun. 27, 2013.

FIELD OF INVENTION

The present invention is directed to a wakeboard and particularly to a wakeboard in which the longitudinal arc or rockerline is reversed along at least one section of the latitudinal axis of the wakeboard.

BACKGROUND

The curvature of the wakeboard from one tip to the other is a significant design feature in determining how much lift a rider will achieve when jumping off of a wake. This longitudinal arch feature is well known in the industry as a wakeboard's "rockerline." A smooth and shallow rockerline will generate more speed up the wake and a rider will be able to travel further horizontally. A more abrupt rockerline towards the tip of the board creates increased vertical height but reduced horizontal distance. Most wakeboards are designed with "twin tip" shapes in which the tip and the tail of the board are generally symmetrical. Generally, in twin tip designs, the rockerline in the front half of the board is also symmetrical with the rockerline in the back half of the board. As such, the lowest point in the rocker line is generally located at the center of the rider's stance.

Historically there have been two shapes of rockerlines: staged and continuous. A continuous rockerline is one uninterrupted curve along the longitudinal axis of the board. A staged rocker board is flat through a center section of the board. At the end of the board's flat spot the curvature of the rockerline increases rapidly to the tip and tail. In either design, a severe rocker means less board contact with the water towards the tip and tail of the board which can often create more drag or resistance for a rider as he/she glides on the water. This drag also hampers the rider's ability to "ollie" or jump from the water without the assistance of the wake. Further, with traditional rockerlines the rider ride with an uneven weight distribution, a rider is not jumping off the wake in as much of a solid, balanced, consistent position. Over time, this added pressure puts more strain on a rider's back leg. Also because of this Thus, a need exists for a new design of the longitudinal curve of a wakeboard that reduces drag while still providing sufficient vertical height when the rider jumps the wake and places the rider in a more ergonomic body position.

SUMMARY

The wakeboard of the invention can be used behind a watercraft, or other device suitable for pulling the rider across a surface of a body of water such as a cable system or wench. It has been discovered that adding at least one section of reversed rockerline or "camber" to the longitudinal axis of the wakeboard forces the water flowing under the board to push the center of the board up on the waterline when in use. This reduces pressure under the rider's back foot and allows the rider to stand with a more equally weighted stance. When the rider has a more centered position over the board, the angle at which the board is positioned relative to the surface of the water or "vertical attack angle" is reduced. A lower vertical attack angle produces less drag as the rider approaches the wake. Because the tail of the board sits higher out of the water the board's capacity to generate lift is also increased. Adding at least one section of camber to the board's rockerline also produces an increase in turbulence under the board that makes the board to sit higher relative to the waterline with less resistance and drag along the board's running surface. This reduction in surface tension means that a rider does not have as much strain on their body while riding. It also has the advantage of creating increased glide speed which is the distance a rider travels at a given speed once they let go of the rope.

The inventive wakeboard leaves the water with less work because the board is riding higher on the water with more turbulence on the contact surface and resulting in a decreased suction effect when the wakeboarder attempts to "ollie" out of the water or jump off the wake. It has also been found that the wakeboard also positions the rider in a more natural evenly weighted body position. When riding a traditional wakeboard, a rider typically is forced into a tail heavy body position as a result of the arc of the board's rocker. This puts more strain on a rider's back leg/foot, and also creates more of an inconsistent pop as a rider has to rely on an unequal weight distribution lift. A rockerline in which the lowest point of the board is not generally centered between the board's tip and tail will naturally plane with more of a centralized equilibrium from the tip of the board to the tail. This allows a rider to have a more equal weight distribution between his or her front and back leg. This puts less strain on a rider's back foot and leg. It also allows a rider to make a more powerful jump off of the wake as a rider is able to drive more evenly with both legs. It would be like jumping off a trampoline with an uneven lift with your legs, as opposed to lifting up using both legs with equal weight.

At least one embodiment of the inventive technology comprises a wakeboard or other type of floatation board, particularly, but not solely, designed for use behind a watercraft and which has a longitudinal arc that curves from the lowest points upward at the tip and tail but is reversed in at least one section of the board. This gives the board multiple low points.

DESCRIPTION

Figure 1:
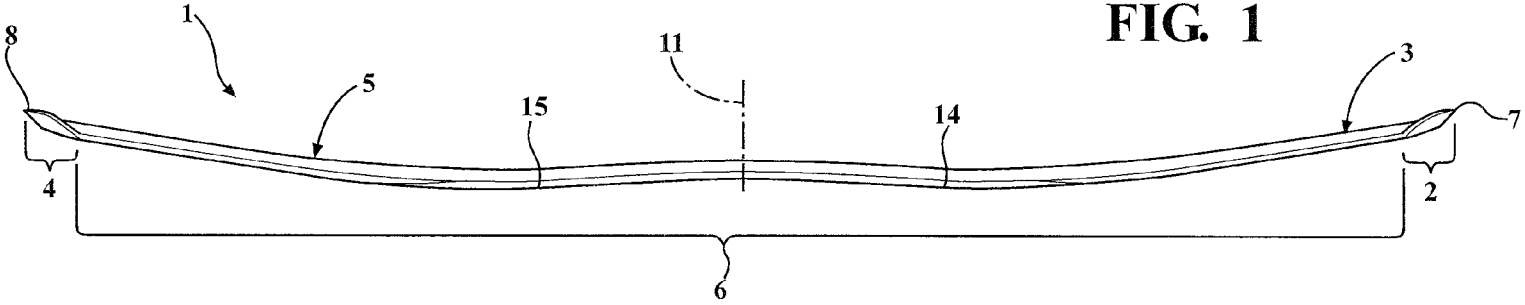
FIG. 1 is a side view of an embodiment of the inventive wakeboard.

The following description is presented to enable a person skilled in the art to make and/or use the invention. For purposes of explanation, specific nomenclature is set forth to provide a thorough understanding of the present invention. The present invention includes a variety of aspects, which may be combined in different ways. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

At least one of the inventive embodiments of the wakeboard, particularly as it relates to twin tip wakeboards, is a wakeboard 1 that comprises a first tip section 2 at the first end 3 of the wakeboard 1 and a second tip section 4 at the second end 5 of the wakeboard 1. The inventive embodiment further comprises an intermediate longitudinal section 6 between the first tip section 2 and the second tip section 4, where the first tip section has a first tip section terminus 7 and the second tip section has a second tip section terminus 8. The intermediate longitudinal section 6 includes a first edge or rail 9 and a second edge or rail 10. The wakeboard 1 of the invention has a longitudinal axis 13 which is generally parallel to the rails; a perpendicular latitudinal axis 12 which runs between first rail 9 and a second rail 10 and is generally parallel to the board's first tip section 2 and the second tip section 4.

FIG. 1 is a side view an embodiment of the inventive wakeboard 1. As depicted in FIG. 1, the wakeboard 1 includes a first tip section 2 located at the first end 3 of the wakeboard 1 and a second tip section 4 at the second end 5 of the wakeboard 1. The wakeboard also has a centerline 11 that is located at the mid-point between the first tip terminus 7 and the second tip terminus 8, and is generally positioned between the rider's feet when the board is in use. The centerline 11 runs along the latitudinal axis 12 (FIG. 2) of the board which is oriented parallel to the first tip section 2 and the second tip section 3.

In FIG. 1 the board's rockerline can be seen starting from the first tip section 2. In the first tip section 2 the board's rockerline rapidly descends from the first tip section terminus 7 all the way across the board's latitudinal axis 12 to the intermediate longitudinal section 6 of the wakeboard 1. In preferred embodiments, the descent may occur at angles between 60 and 30 degrees. The rockerline then descends less rapidly through the intermediate longitudinal section 6 all the way across the board's latitudinal axis 12 to the first low point 14. In preferred embodiments, this descent may occur at angles between 30 and 3 degrees. At the first low point 14 the rockerline inverts and ascends through the intermediate longitudinal section 6 all the way across the board's latitudinal axis 12 between the first low point 14 and the centerline 11. In preferred embodiments, this descent may occur at angles between 10 and 0.05 degrees. At the centerline 11 the rockerline inverts again and descends through the intermediate longitudinal section 6 all the way across the board's latitudinal axis 12 between the centerline 11 and the second low point 15. In preferred embodiments, this ascent may occur at angles between 10 and 0.05 degrees. At the second low point 15 the rockerline inverts again and ascends through the remainder of the intermediate longitudinal section 6 all the way across the board's latitudinal axis 12 between the second low point 14 and the second tip section 4. In preferred embodiments, this ascent may occur at angles between 30 and 3 degrees. In the second tip section 4 the board's rockerline rapidly descends all the way across the board's latitudinal axis 12 from the second tip section terminus 8 to the intermediate longitudinal section 6 of the wakeboard 1. In preferred embodiments, the descent may occur at angles between 60 and 30 degrees. This creates a rockerline in which the lowest point of the board is not generally centered between the board's first tip section 2 and second tip section 4.

Figure 2:
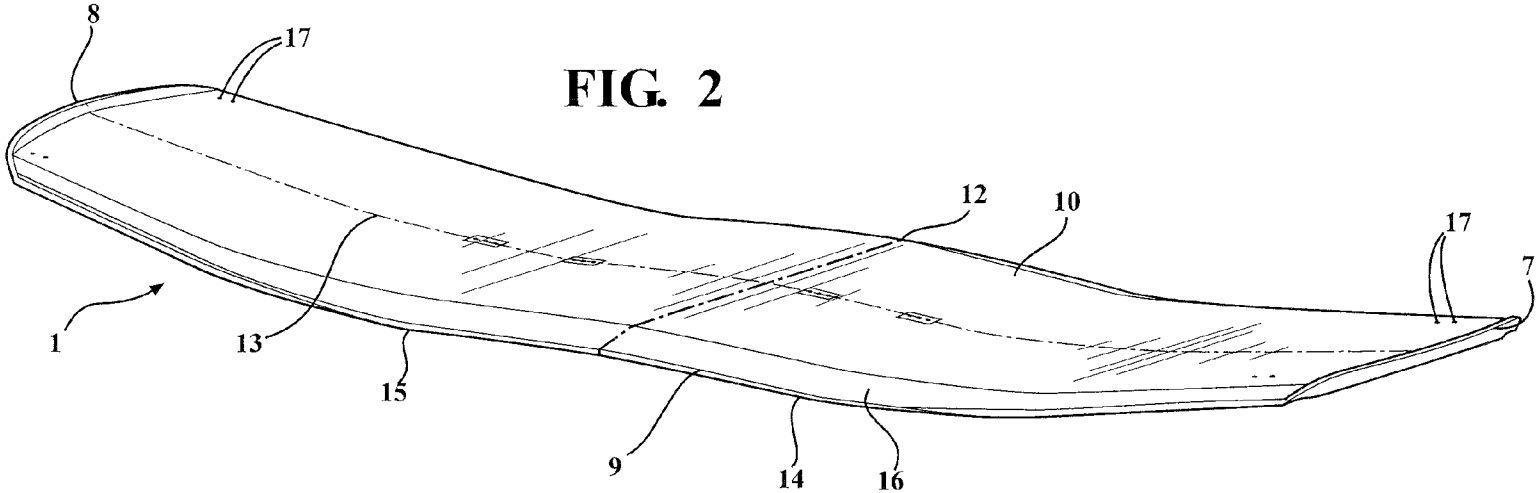
FIG. 2 is a side perspective view of the top of an embodiment of the inventive wakeboard.

FIG. 2 is a perspective view of the top of an embodiment of the inventive wakeboard 1. As depicted in FIG. 2, the wakeboard 1 includes a longitudinal axis 13 that runs from the first tip section terminus 7 to the second tip section terminus 8. A first low point 14 and a second low point 15 are also depicted. Preferably, the intermediate longitudinal section 6 (FIG. 1) is between one quarter and two inches thick. The intermediate longitudinal section 6 has a tapered edge 16 as it approaches both the first rail 9 and the second rail 10. Tapered edge 16 preferably starts between one half and five inches from either the first rail 9 or the second rail 10. Holes 17 for the attachment of fins 18 (FIG. 3) may be located in the intermediate longitudinal section 6. In a preferred embodiment, four holes 17 are placed at the first end 3 near the junction of the intermediate longitudinal section 6 and first tip section 2. Two holes 17 are generally oriented parallel to the longitudinal axis 13 and positioned one to three inches from the first rail 9. Two holes 17 are generally oriented parallel to the longitudinal axis 13 and positioned one to three inches from the second rail 10. Four holes 17 are placed at the second end 5 near the junction of the intermediate longitudinal section 6 and second tip section 4. Two holes 17 are generally oriented parallel to the longitudinal axis 13 and positioned one to three inches from the first rail 9. Two holes 17 are generally oriented parallel to the longitudinal axis 13 and positioned one to three inches from the second rail 10. Fins 18 may be inserted into each set of holes 17.

Figure 4:
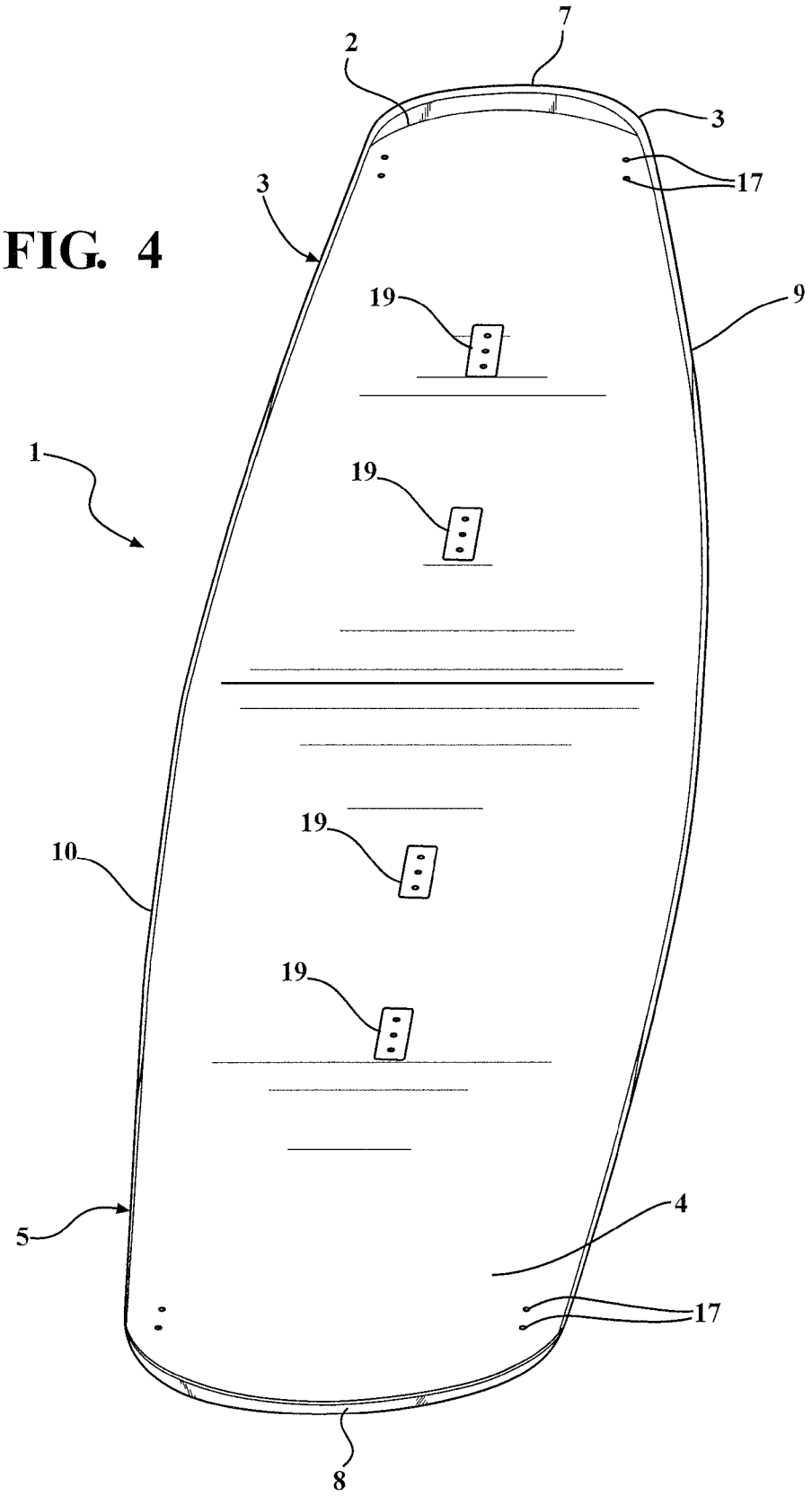
FIG. 4 is a rear, perspective view of the top of an embodiment of the inventive wakeboard.

FIG. 4 is a rear, perspective view of the top of an embodiment of the inventive wakeboard 1. In FIG. 4, binding mounting holes 19 generally located near the first low point 14 and a second low point 15 are also depicted. In a preferred embodiment, six binding mounting holes 19 are drilled along the longitudinal axis near the first low point 14. Six binding mounting holes 19 are drilled along the longitudinal axis near the second low point 15. Each set of binding mounting holes 19 is generally centered over low points 14 and 15 with three holes placed on each side. Holes 19 are placed six inches apart to accommodate a standard six inch binding mount.

Figure 3:
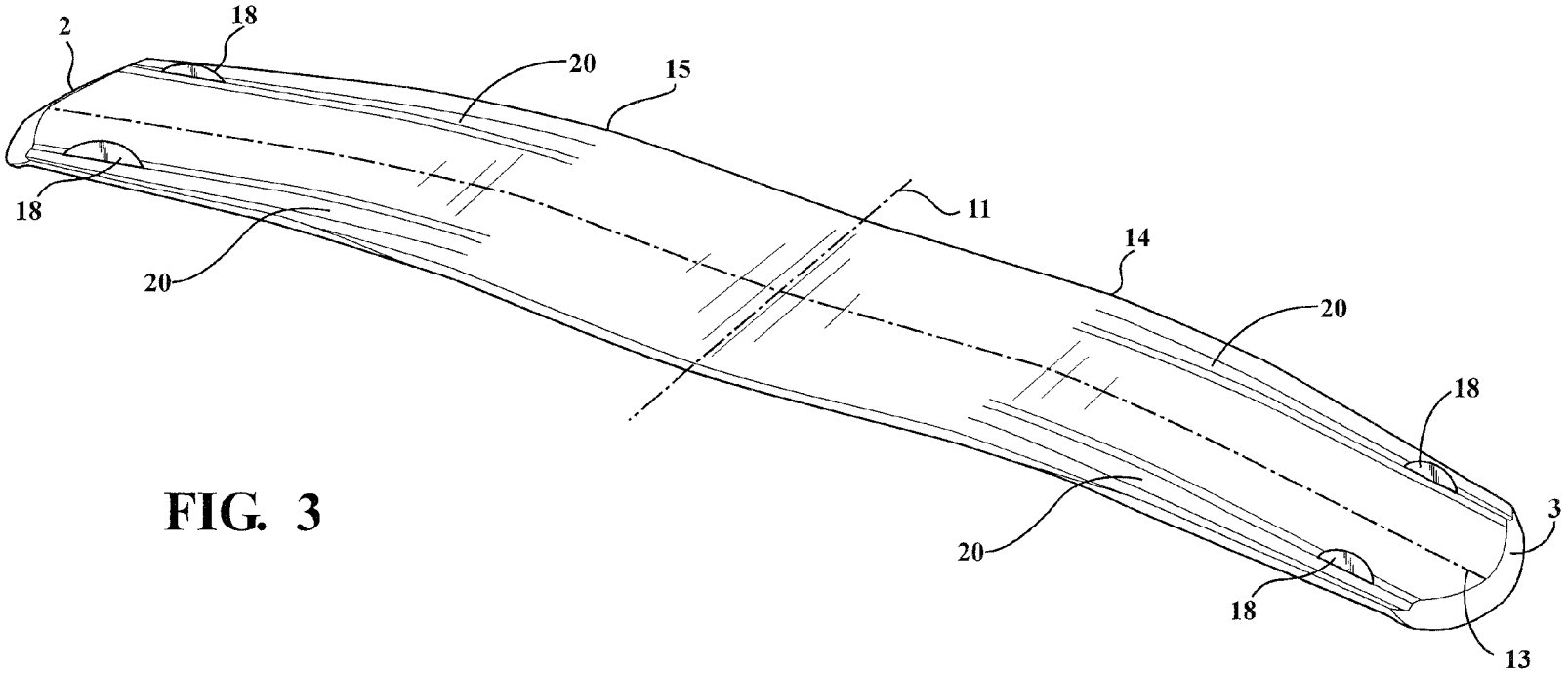
FIG. 3 is a side perspective view of the bottom of an embodiment of the inventive wakeboard.

FIG. 3 is a side, perspective view of the bottom of an embodiment of the inventive wakeboard 1. As depicted in FIG. 3, a preferred embodiment of the inventive wakeboard 1 includes channels 20 running parallel to the longitudinal axis 13 between the first tip section 2 and the first low point 14 and the second tip section 4 and the second low point 15. In preferred embodiments, channels 20 are positioned one to five inches from the first rail 9 at the second end 5; one to five inches from the second rail 10 at the second end 5; one to five inches from the first rail 9 at the first end 3; and one to five inches from the second rail 10 at the first end 3.

Thus the reader will see that the wakeboard of the invention includes a rockerline in which the lowest point of the board is not generally centered between the board's tip and tail.

While the above description contains many specifics, these should not be construed as limitations on the scope of the invention, but rather as an exemplification of one preferred embodiment thereof many other variations are possible including a rockerline with multiple cambers, a rockerline with at least one camber that does not peak at the centerline, etc. Accordingly, the scope of the invention should be determined not by the embodiments illustrated, but by the appended claims and their legal equivalents.

The invention claimed is:

1. A wakeboard comprising:

a longitudinal axis and latitudinal axis; a first tip section at a first end of the wakeboard and a second tip section at a second end of the wakeboard;

an intermediate longitudinal section between the first and second tip section wherein said intermediate longitudinal section includes a centerline, a first rail, a second rail, a first low point, and a second low point; and a rockerline that ascends and then descends through the intermediate longitudinal section substantially across the board's latitudinal axis between the first low point and the second low point and alters the displacement of water flowing beneath the board.

2. The wakeboard of claim 1 further comprising a rockerline that ascends through the intermediate longitudinal section between the first low point and the centerline and descends between the centerline and the second low point.

3. The wakeboard of claim 1 wherein the rockerline contains two low points.

4. The wakeboard of claim 3 wherein the first low point defines the transition between the first tip section and the intermediate longitudinal section.

5. The wakeboard of claim 3 wherein the second low point defines the transition between the second tip section and the intermediate longitudinal section.

6. The wakeboard of claim 5 further comprising a rockerline that ascends from the second low point through the second tip section.

7. The wakeboard of claim 5 wherein the descent of the rockerline through the first tip section to the first low point occurs at angles between 30 and 3 degrees.

8. The wakeboard of claim 6 wherein the ascent of the rockerline from the second low point through the second tip section occurs at angles between 30 and 3 degrees.

9. The wakeboard of claim 2 wherein the ascent of the rockerline within the intermediate longitudinal section between the first low point and the centerline occurs at angles between 10 and 0.05 degrees.

10. The wakeboard of claim 2 wherein the descent of the rockerline within the intermediate longitudinal section between the centerline and the second low point occurs at angles between 10 and 0.05 degrees.

11. The wakeboard of claim 1 wherein the intermediate longitudinal section is tapered as it approaches the first rail and the second rail.

12. The wakeboard of claim 11 wherein tapering starts between one half and five inches from either the first rail or the second rail.

13. The wakeboard of claim 2 further comprising binding mounting holes located near the first low point and the second low point.

14. The wakeboard of claim 13 wherein six binding mounting holes are located along a longitudinal axis near the first low point and six binding mounting holes are located along the longitudinal axis near the second low point.

15. The wakeboard of claim 1 further comprising channels run parallel to the longitudinal axis within the intermediate longitudinal section.

16. The wakeboard of claim 2 further comprising channels run parallel to the longitudinal axis between the first tip section and the first low point and between the second tip section and the second low point.

17. The wakeboard of claim 16 wherein a channel is positioned one to five inches from the first rail at the second end; one to five inches from the second rail at the second end; one to five inches from the first rail at the first end; and one to five inches from the second rail at the first end.

18. The wakeboard of claim 1 further comprising holes for the attachment of fins.

19. The wakeboard of claim 18 wherein:

two holes are generally oriented parallel to the longitudinal axis and positioned one to three inches from the first rail at the first end;

two holes are generally oriented parallel to the longitudinal axis and positioned one to three inches from the second rail at the first end;

two holes are generally oriented parallel to the longitudinal axis and positioned one to three inches from the first rail at the second end; and two holes are generally oriented parallel to the longitudinal axis and positioned one to three inches from the second rail at the second end.

20. The wakeboard of claim 4 further comprising a rockerline that ascends from the first low point through the first tip section.

* * * * *